United States Patent [19]

Lewis

[11] 3,983,687

[45] Oct. 5, 1976

[54] METHOD OF PRODUCING COVERED ELASTIC YARN

[75] Inventor: George Lewis, Arnold, England

[73] Assignee: Courtaulds Limited, London, England

[22] Filed: Apr. 10, 1975

[21] Appl. No.: 566,750

Related U.S. Application Data

[63] Continuation-in-part of Ser. No. 347,655, April 14, 1973, abandoned.

[30] Foreign Application Priority Data

Apr. 10, 1972 United Kingdom .....16379/72

[52] U.S. Cl. ..... 57/163; 57/157 S; 57/157 MS

[51] Int. Cl.[2] ..... D02G 3/32

[58] Field of Search ..... 57/152, 163, 12, 16, 57/17, 18, 341, 157 R, 157 MS; 264/290 R, 290 N, 290 T, 288

[56] References Cited

UNITED STATES PATENTS

| | | | |
|---|---|---|---|
| 3,387,448 | 6/1968 | Lathem et al. | 57/152 |
| 3,387,451 | 6/1968 | Cape et al. | 57/163 |
| 3,527,045 | 9/1970 | Wilson | 57/152 |

FOREIGN PATENTS OR APPLICATIONS

| | | | |
|---|---|---|---|
| 970,791 | 9/1964 | United Kingdom | 57/163 |

*Primary Examiner*—John Petrakes
*Attorney, Agent, or Firm*—Davis, Hoxie, Faithfull & Hapgood

[57] ABSTRACT

A method of producing an elastic yarn comprising preparing a covered unstabilised elastic yarn, transferring the yarn to a heat treatment machine, unwinding the yarn from a package, drafting the covered elastic yarn to extend it, and heating the covered elastic yarn whilst it is being drafted to set it in an extended state. The elastic yarn may have one covering yarn or two covering yarns applied separately, and the or each covering yarn may be a polyamide yarn.

6 Claims, 4 Drawing Figures

FIG.3.
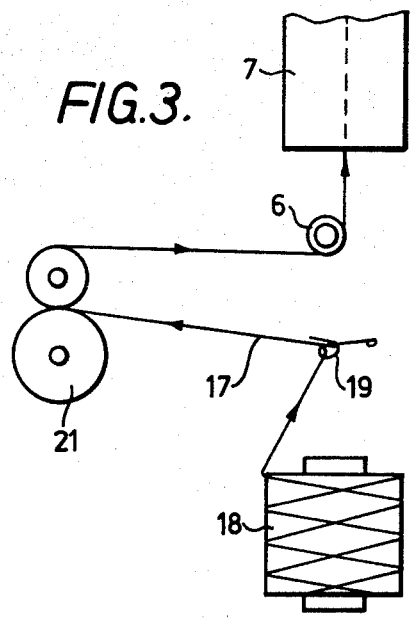
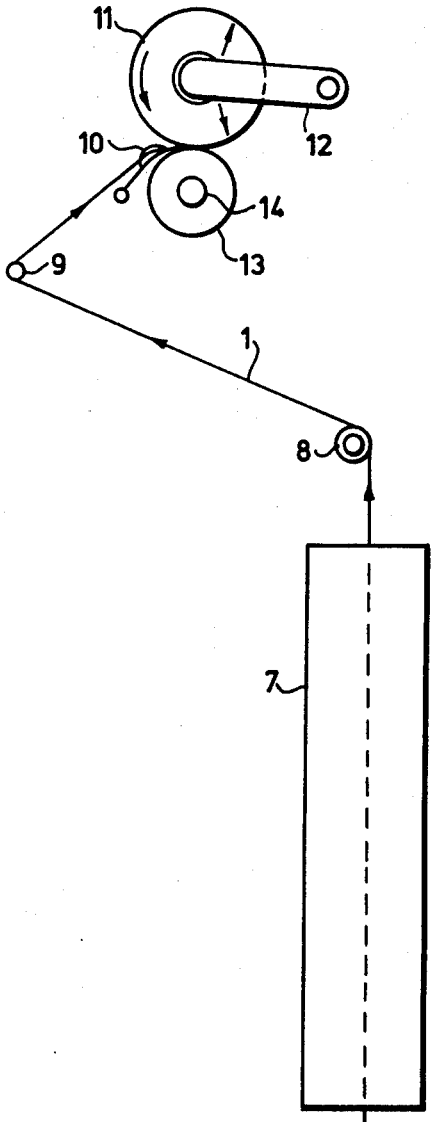
FIG.4.
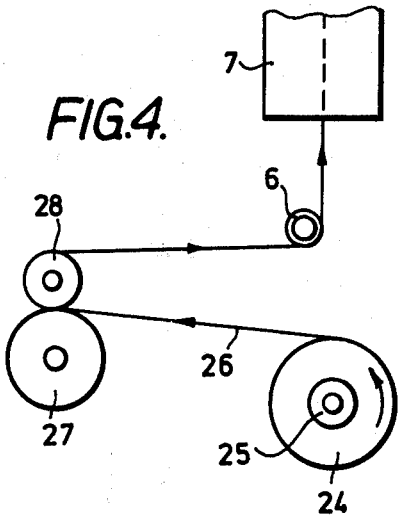
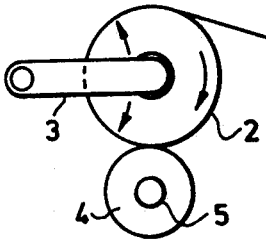
FIG.2.

METHOD OF PRODUCING COVERED ELASTIC YARN

This is a continuation-in-part of my copending application Ser. No. 347,655, filed Apr. 4, 1973, now abandoned.

BACKGROUND OF THE INVENTION

This invention relates to the production of a stabilised, covered elastic yarn.

It is known to manufacture elastic yarn by covering a core of elastic synthetic polymeric material with a covering thread. It is also known to stabilise the elastic synthetic polymeric material by stretching it and setting the stretch by heat before covering. The present invention is based on the appreciation that it is advantageous to draw and heat treat the yarn, in a running operation, after the cover has been placed on the core.

It is an object of the invention to provide a method of making a stabilised covered elastic yarn which method is easier to carry out and supervise than previous methods, is more economical, and produces a product exhibiting a more intimate bond between covering yarn and core than previous covered elastic yarns so that the yarn has improved snag resistance in subsequent processing. In the method of the invention the yarn is heat treated briefly to set and stabilise it temporarily but in such a way that the elasticity can be restored by subsequent processing.

SUMMARY OF THE INVENTION

The invention consists in a method of producing a covered elastic yarn comprising the steps of covering an unstabilised elastic polymeric core yarn by passing the yarn through a winding station whilst winding a heat-shrinkable continuous filament covering yarn thereon, and collecting the covered yarn and thereafter transferring the covered unstabilised yarn to a heat treatment machine, unwinding the covered unstabilised yarn from a package and passing the yarn through said machine wherein it is concurrently subjected to a drafting action, to draw the core yarn and reduce its tex count, and to a heating action of less than 1 second duration, to stabilise the core yarn and set it temporarily to a desired tex count at least 10% lower than the tex count of the unstabilised core, said drafting action extending the core yarn to at least 150 percent of its unextended length and, with the heating action, reducing the elongation to break of said yarn to 150 percent or less, and said heating action producing a shrinkage in said covering yarn of at least 5 percent.

BRIEF DESCRIPTION OF THE DRAWINGS

The invention will be further described, by way of example, with reference to the accompanying drawings illustrating methods of producing an elastic yarn according to the invention.

In the drawings:

FIGS. 2 to 4 show alternative methods of carrying out a second stage of the method of the invention in which covered unstabilised elastic yarn is heat treated and drafted.

DESCRIPTION OF THE PREFERRED EMBODIMENTS

Figure 1:
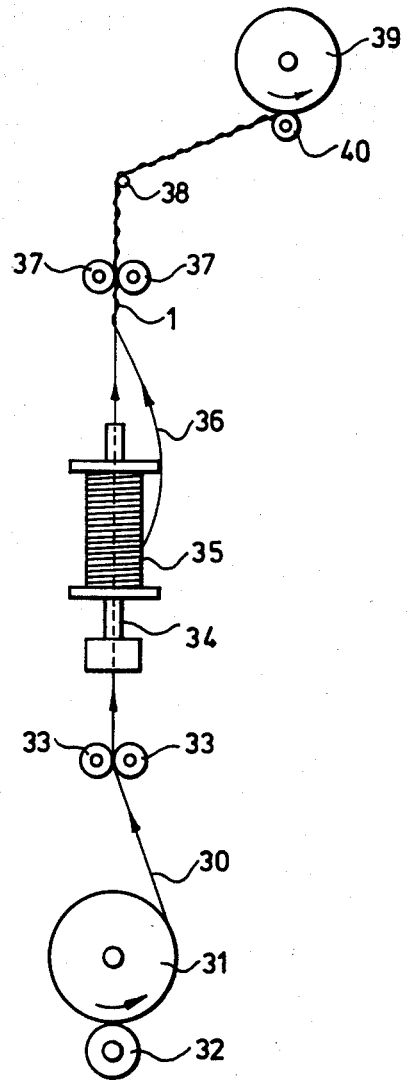
FIG. 1 shows a first stage of the method of the invention in which unstabilised elastic yarn is covered.

In FIG. 1, a bare unstabilised elastic polymeric yarn 30 is unwound from a supply package 31 surface driven by a roller 32. The yarn passes between feed rollers 33, 33 and freely through a winding station comprising a hollow spindle 34 on which is supported a bobbin 35 of heat shrinkable continuous filament yarn 36. The spindle 34 and bobbin 35 are rotated by a drive (not shown) to wrap the covering yarn 36 on the unstabilised elastic yarn 30. The covered yarn 1 is forwarded through nip rollers 37, 37 and over a guide 38 for collection to a take up package 39 surface driven by a roller 40.

Two covering yarns may be placed on the core yarn by including two bobbins 35 in the apparatus, the core yarn 30 passing through the two bobbins 35 in succession.

FIG. 2 of the drawing shows the covered elastic yarn 1, now transferred to a drafting and heat treatment machine, being unwound from a package constituted by a spool 2 carried on a swinging arm 3 mounted on a machine frame (not shown). The spool 2 is surface driven by a roll 4 mounted on a driven shaft 5. The unwound yarn 1 is led over a guide pulley 6 and through a heater 7 in which it is heated by contact with a metal plate (not shown). After emerging from the heater 7 the yarn 1 passes round a guide pulley 8, over a guide bar 9 and through a traversing guide 10 which lays the yarn 1, under tension, on a spool ll carried on a swinging arm 12, also mounted on the machine frame, and surface driven by a driven roll 13 mounted on a shaft 14. The roll 13 is driven, for example by a belt, from a variable speed motor (not shown) allowing the yarn to be subjected to a drafting action as it passes through the heater 7. By coordinating the speeds of the rolls 4 and 13, the desired drafting action and the correct yarn speed to give the heat treatment required are achieved. The temperature of the heater 7 is also adjustable by means of a thermostat (not shown). The roll 4 which feeds the yarn into the concurrent drafting and heating stage is driven through a positive drive (not shown) incorporating gearing allowing its speed to be adjusted.

The spool 2 and the spool 11 are driven at such speeds as to draft the yarn between the spool 2 and the spool 11 and place it under tension so as to extend it to an elongation of from 150 to 290 percent based on the unextended length of the yarn. The yarn may be wound onto the package 2 with an elongation of, for example 100 percent based on the unextended length of the yarn and the additional elongation imposed in the heating stage is then only 50 to 190 percent of the unextended length of the yarn. The yarn 1 is wound onto the spool 11 under tension so that the elongation imposed by the drafting is set in the yarn on cooling below the heater temperature.

The linear speed of the yarn passing through the heater 7 may be from 45 to 400 meters per minute, preferably above 200 meters per minute. The heated plate in the heater may be at a temperature of from 195° to 245°C and the length of the heater is such in relation to the yarn speed that the dwell of any portion of the covered elastic yarn in the heater is less than one second, advantageously less than 0.3 second and it may be less than 0.1 second. The heater length and temperature and yarn speed are chosen to produce desired elongation characteristics in the product.

Besides stabilising the yarn by reducing its extensibility, the heat treatment has the effect of reducing the count of the yarn, in effect the core yarn, by a percentage of from 10 to 60 percent, for example from 11.1 to 6.6 tex, from 7.7 to 3.9 tex, from 5.5 to 2.2 tex, from 4.4 to 1.9 tex.

Advantageously, the covered elastic yarn comprises a core of segmented polyurethane on which is wrapped a covering of a flat multi-filament polyamide yarn. For example, a 7 filament 1.0 tex polyamide yarn may be used to cover a 5.5 tex polyurethane yarn. The covering yarn may be of the same degree of fineness as the core yarn, or it may be finer than the core yarn. For example the covering yarn may have a tex count which is 50 or 25 percent or even less than 25 percent of the tex count of the core yarn. The covering may comprise one or two wrappings of yarn wrapped at a pitch of from 1 to 10 turns per centimeter of core passing the wrapping point. Advantageously, the or each wrapping is applied at a pitch of from 1 to 4 turns per centimeter. A low frequency of wrapping turns contributes to manufacture of a low cost yarn. If two wrappings are used they are applied separately, although they may be applied in the same operation, and they may be applied in the same sense or in opposite senses.

The covering yarn is chosen so that it shrinks during the heat treatment, for example, by from 5 to 10 percent based on its length before heat treatment and this shrinkage under the action of drafting and heat treatment has the effect of binding the covering yarn more intimately to the core yarn to produce an improved core-covering yarn combination in which the covering yarn protrudes less from the core than in a conventional covered yarn and is less susceptible to snagging.

The heat treatment should reduce the elongation to break of the covered elastic yarn to below 150 percent, preferably to from 70 to 150 percent, based on the unextended length of the yarn, the elongation to break being that elongation which results in breakage of one component of the covered yarn. Usually a covering component is the first to break. An elastic yarn stabilised to an elongation within the range mentioned can be more easily handled in later processing stages. For example, it can be more readily knitted on a knitting machine. The elongation to break of the covered elastic yarn 1 unwound from the spool 2 may be from 400 to 600 percent. The reduction in the elongation to break is achieved, in the present example, through two factors. First the relaxation of the covering yarn and secondly the setting of the extension in the core yarn. The elongation to break of the covered elastic yarn can be increased again by a heat treatment following incorporation of the yarn in a fabric.

FIG. 3 of the drawing shows an alternative method of unwinding yarn from a package and feeding it into the heating stage. The yarn 17 is wound on a spool 18 and is unwound over end through a guide 19 which tensions the yarn to prevent snarling. The yarn is then passed into the nip between a nip roller 20 and a driven roll 21 and finally over a guide roller 6 before entering the heater 7 as in FIG. 2. The remaining parts of the treatment machine are the same as in FIG. 2.

FIG. 4 of the drawing shows a further method of feeding the yarn into the heating stage. A spool 24 is mounted on free running bearings 25 which allow the spool to rotate under tension of the yarn being drawn off and yarn 26 is unwound from the spool by means of a driven roll 27 and a nip roller 28. The yarn then passes round a guide pulley 6 and into the heater 7 as in FIG. 2. Some frictional restraint may be applied to the spool 24 to prevent over running.

Investigation of the effect of the heat treatment of less than one second duration on the yarn made of elastic synthetic polymeric material used as the core in elastic covered yarn produced according to the present invention confirms that the effect on the core is to set it temporarily in a finer condition so that the elasticity can be restored by later heat processing. For example an elastic core having a tex of approximately 4.4 was reduced to a tex of approximately 4.2 after covering and prior to heat treatment, whereas after heat treatment the core tex was approximately 2.8. Advantageously, the tex of the core is reduced by covering and heat treatment by an amount of from 35 to 50 percent based on the original tex of the core.

The reduction in elongation to break of the core is illustrated by an example in which the elongation to break of a low modulus polyurethane core was 550 percent prior to covering, 425 percent after the covering operation but before heat treatment, and 270 percent after the heat treatment (the elongation to break being measured, in the latter two cases, after removal of the covering). The elongation to break increased once more upon heating the elastic yarn again. After heating in steam in an autoclave for approximately 90 seconds the core of the yarn had an elongation to break of 330 percent and a tex of approximately 3.9.

Advantageously, the core of the elastic yarn produced according to the invention is a low modulus polyurethane having a breaking tenacity (gms force/-tex) of less than 7.0, preferably above 5.0, and an elongation to break above 500 percent. Preferably the yarn is produced by a process in which it is stretched immediately after spinning to a comparatively small extent (less than 100 percent). In the covering operation the core yarn is preferably stretched by more than 200 percent, advantageously by approximately 300 percent.

What is claimed is:

1. A method of producing a covered elastic yarn comprising the steps of covering an unstabilised elastic polymeric core yarn by passing the yarn through a winding station whilst winding a heat-shrinkable continuous filament covering yarn thereon, and collecting the covered yarn, and thereafter transferring the covered unstabilised yarn to a heat treatment machine, unwinding the covered unstabilised yarn from a package and passing the yarn through said machine wherein it is concurrently subjected to a drafting action, to draw the core yarn and reduce its tex count, and to a heating action, of less than 1 second duration, to stabilise the core yarn and set it temporarily to a desired tex count at least 10 percent lower than the tex count of the unstabilised core, said drafting action extending the core yarn to at least 150 percent of its unextended length and, with the heating action, reducing the elongation to break of said yarn to 150 percent or less, and said heating action producing a shrinkage in said covering yarn of at least 5 percent.

2. A method as claimed in claim 1 wherein the covering yarn relaxes to the extent of from 5 to 10 percent based on its unextended length before subjection to the heating.

3. A method as claimed in claim 2 wherein the covering yarn is a polyamide yarn and the core yarn is segmented polyurethane.

4. A method as claimed in claim 3 wherein said heating action has a duration of less than 0.3 second.

5. A method as claimed in claim 4 wherein the covered elastic yarn is heated by contact with a metal plate at a temperature of from 195°C to 245°C.

6. A method as claimed in claim 3, wherein the core yarn is stretched during the covering operation by more than 200 percent.

* * * * *

UNITED STATES PATENT OFFICE
CERTIFICATE OF CORRECTION

PATENT NO. : 3,983,687

DATED : October 5, 1976

INVENTOR(S) : George Lewis

It is certified that error appears in the above-identified patent and that said Letters Patent are hereby corrected as shown below:

Title Page:

[63] Continuation-in-part of Ser. No. 347,655, April 14, 1973, abandoned.

"April 14, 1973" should be --April 4, 1973--.

Signed and Sealed this

Fourth Day of January 1977

[SEAL]

*Attest:*

RUTH C. MASON
*Attesting Officer*

C. MARSHALL DANN
*Commissioner of Patents and Trademarks*